US005894261A

United States Patent [19]

Green

[11] Patent Number: 5,894,261

[45] Date of Patent: Apr. 13, 1999

[54] SCORE KEEPING DISPLAY APPARATUS

[76] Inventor: Richard Green, 1000 E. Atlantic Blvd., #202, Pompano Beach, Fla. 33360

[21] Appl. No.: 08/940,257

[22] Filed: Sep. 30, 1997

Related U.S. Application Data

[XX .

[60] Provisional application No. 60/027,131, Sep. 30, 1996.

[51] Int. Cl.[6] ..... G08B 23/00

[52] U.S. Cl. ..... 340/323 R; 273/371; 273/DIG. 26; 364/411.1

[58] Field of Search ..... 340/323 R; D10/46.1; 273/371, DIG. 26; 377/5; 364/411.1

[56] References Cited

U.S. PATENT DOCUMENTS

| | | | |
|---|---|---|---|
| D. 210,608 | 3/1968 | Schaefer et al. | D34/5 |
| D. 229,076 | 11/1973 | Kurtenbach et al. | D21/2 |
| 3,399,400 | 8/1968 | Lucka | 340/323 R |
| 3,868,671 | 2/1975 | Maguire et al. | 340/323 R |
| 3,981,002 | 9/1976 | Gardner | 340/323 R |
| 4,286,323 | 8/1981 | Meday | 340/323 R |
| 5,531,453 | 7/1996 | Penston, III | 273/440 |
| 5,574,422 | 11/1996 | Martin | 340/323 R |

OTHER PUBLICATIONS

Popular Mechanics, "Two–Ton Clock Flashes the Score", p. 12, Jun. 1943, 340–323 R.

*Primary Examiner*—Brent A. Swarthout
*Attorney, Agent, or Firm*—Robert M. Downey, PA

[57] ABSTRACT

A score keeping display apparatus includes a three-sided, generally triangular scoring display tier, each side of the display tier including two sets of dual character displays and two sets of LED indicators associated with each of the displays. The scoring display tier is supported on the upper end of a vertical post which is anchored at an opposite end to a base control unit. The base control unit is connectable to a power supply and contains a battery, battery charger, control circuit board, mini displays replicating the display tier, and control switches for operating the scoring display.

15 Claims, 5 Drawing Sheets

SCORE KEEPING DISPLAY APPARATUS

This application is a continuation of provisional application Ser. No. 60/027,131 filed Sep. 30, 1996.

BACKGROUND OF THE INVENTION

1. Field of the Invention

The present invention relates to a score keeping display apparatus and, more specifically to a portable electronic scoreboard having a multi-sided scoring display supported approximately 6 feet above a base control unit having means thereon for controlling the scoring display.

2. Description of the Related Art

Virtually all spectator sports provide for scoring displays to indicate a current score, games, or match status as well as other pertinent information. At some facilities, where a large number of spectators are normally present to watch a single event, a large, expensive and highly sophisticated scoring display system is usually permanently installed so that it is viewable by everyone in the facility. In an indoor facility, such as in an arena, the display is usually multi-sided and supported from the rafters or ceiling structure so that it is maintained near the center of the arena, above the playing area. Scoreboards of this nature are usually used during college and professional basketball and hockey games. Even larger facilities, such as football and baseball stadiums, use very large, permanently installed electronic scoreboards for displaying a wide assortment of information to the crowd.

Other sports, such as volleyball, are not suited for such large scoring displays. This is particularly the case in the instance of a volleyball tournament wherein a number of different games are being played simultaneously on one facility, such as a large gymnasium, convention hall, or arena. Presently, the most commonly employed method of volleyball score keeping involves the use of a manually operated display comprising a plurality of display cards which are individually flipped over retaining rings to display a next successive number on the next card. Keeping score in this manner has proven to be time-consuming and inconvenient for scorekeepers, players, and spectators. Further, because conventional volleyball score keeping displays are usually only one-sided, and sometimes two-sided, they are not easily viewable by all players and spectators.

Accordingly, there exists a need for a portable electronic scoreboard which is particularly suited for volleyball score keeping and which includes a highly visible, multi-sided scoring display supported at a height of at least 6 to 8 feet above the ground.

SUMMARY OF THE INVENTION

The present invention is directed to a score keeping display apparatus having a plurality of score displaying sets, wherein each set includes a pair of dual character displays as well as other display means for displaying information relevant to an event, and particularly a sporting event. Further, the scope display sets are capable of displaying scores and other information for a plurality of participants in the event.

A score display housing includes three or more side faces disposed in angled relation to one another about the sides of the housing. Each of the side faces is structured to accommodate one of the score display sets in a manner which permits visibility of the score display set up to a predetermined range of distance from the housing. In this manner, when the housing is supported in an operative viewing position, the score and other information displayed by the score display sets is visible from positions about a 360° viewing area surrounding the apparatus. The range (i.e., distance) of visibility is primarily dependent on the type and size of the dual character displays and the other indicators of the score displaying sets. At present, the preferred type of dual character displays for optimal visibility are LED type or electro-mechanical vane type displays.

A base control unit includes base display means corresponding with the score display sets on the score display housing for simultaneously displaying the score and other information being displayed by the score display sets. The base control unit further includes control means for controlling the score display sets and the base display means. More particularly, the base control unit includes a control circuit board, mini scoring displays replicating the score display sets, and control switches for operating the score displays. The base unit may be connectable to an external power supply and/or may include an internal battery (batteries) and battery charges.

The score display housing as supported in the operative viewing position on a post. The post has an upper end zone coupled to a bottom of the display housing and an opposite lower end zone anchored within the base control unit, to thereby support the display housing at a height of at least 3 feet, and preferably about 6 feet, above the bass control unit.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed to a portable electronic score keeping display apparatus generally indicated as 10 throughout the several views of the drawings.

Figure 1:
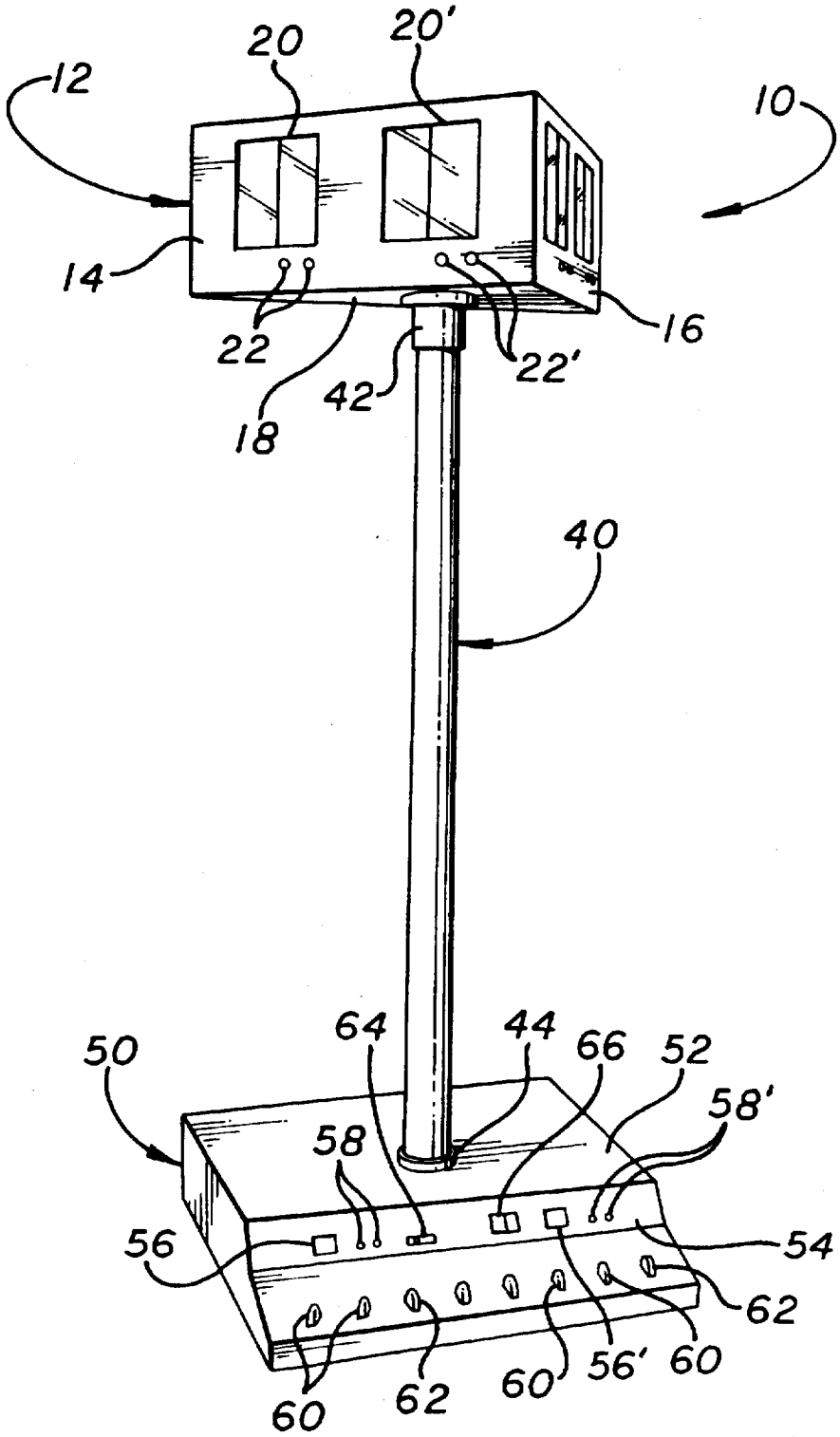
FIG. 1 is a perspective view of the score keeping display apparatus of the present invention.
Figure 2:
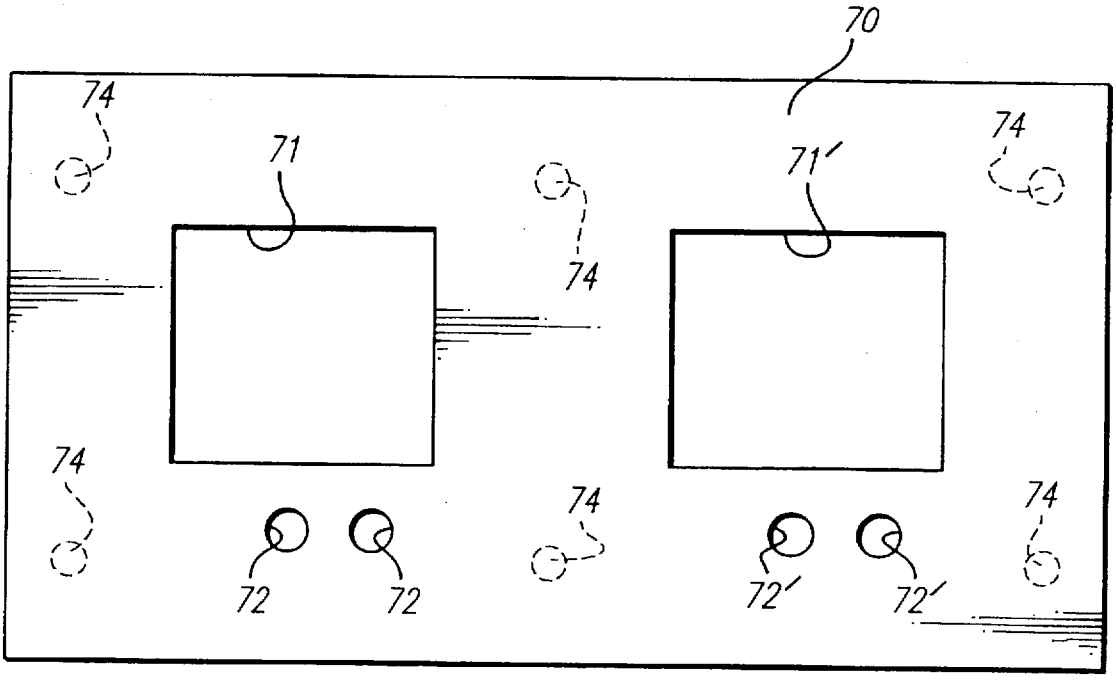
FIG. 2 is a front view of the character display front panels a component of the scoring display apparatus.
Figure 3:
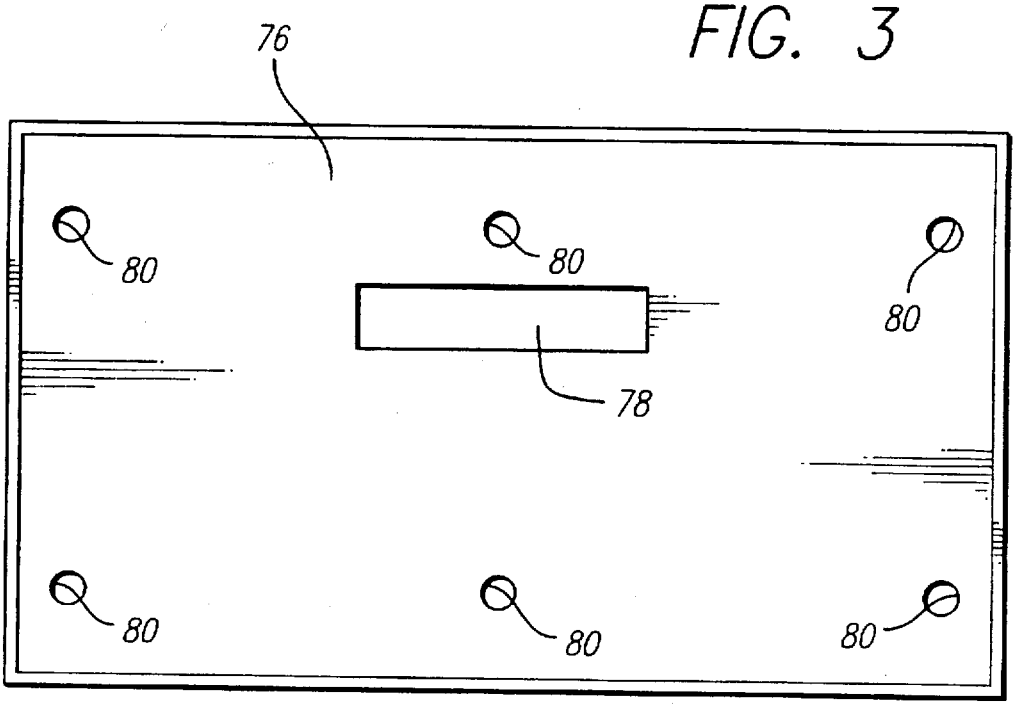
FIG. 3 is a front view of the character display front panel covers a component of the scorning display apparatus.

The apparatus 10 includes a multi-sided, generally triangular shaped scoring display housing 12. The three vertically oriented sides or panels 14, 16, 18 (not visible in FIG. 1) of the scoring display housing 12 are each provided with two dual character displays 20, 20'. In one embodiment, the dual character displays 20, 20' are provided with 4 inch high seven-segment LED's which provide long range, high definition visibility. In another embodiment, the dual character displays 20, 20' are electro-mechanical vane displays. The orientation of the sides of the display housing ensures 360° visibility of the displays thereon.

Each display panel (14, 16 and 18) is further provided with two sets of round LED indicators 22, 22'. Each set includes two indicators associated with one of the two character displays. The round LED indicators are used to indicate the total number of games won for the team whose score is displayed on the associated character display above that set of indicators.

In the preferred embodiment, there is one metallic or plastic front panel 70 for each display panel assembly (14, 16 and 18). The front panel features two squares through holes 71, 71'. The square holes 71, 71' are positioned to align with the dual character displays 20, 20'. Additionally, round through holes 72, 72' for the round LED indicators 22, 22' are provided and located below the square holes. Furthermore, six 8–32 studs 74 protrude from the back of the front panel 70. Three of the studs are spaced evenly along the upper peripheral zone of the panel with one centered and one near each corner. The remaining three studs are spaced similarly along the bottom peripheral zone of the panel.

In the preferred embodiment, there is one metallic or plastic front panel cover 76 for each of the display panel assemblies (14, 16 and 18). A feature of the cover is a rectangular through hole centered horizontally and vertically offset towards the upper peripheral zone of the panel. Additionally, six round through holes 80 in the cover 76 are positioned to align with the studs 74 in the front panel 70. Three of the holes 80 are spaced evenly along the upper peripheral zone of the cover 76 with one horizontally centered and one near each corner. The remaining holes are spaced similarly along the bottom peripheral zone of the cover.

Figure 4:
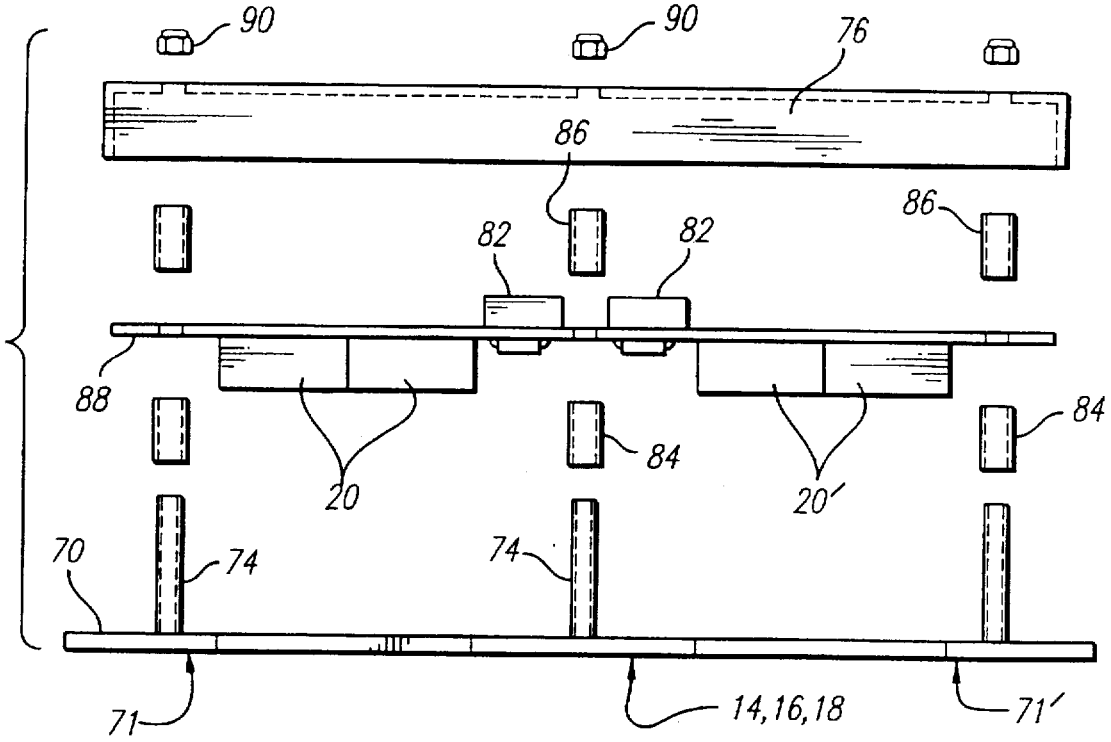
FIG. 4 is an exploded top view of the character display panel assembly of the apparatus.

As shown in FIG. 4, six lower spacers 84 are positioned over the shafts of the six 8–32 studs 74 and positioned between the front panel 70 and the PC board 88, one spacer per stud. The PC board 88 is positioned so that the studs 74 protrude through the aligned holes in the PC board 88. The two dual character displays 20, 20' and the round LED indicators 22, 22' which are mounted to the PC board 88 fit into the through holes 71, 71' and 72, 72' of the front panel 70 respectively. Six upper spacers 86 are positioned over the shafts of the studs 74 between the PC board 88 and the front panel cover 76, one spacer per stud. The front panel cover 76 is positioned so that the studs 74 protrude through the holes 80 in the cover 76 and the ribbon cable connectors 82 align with the square through hole 78. There is one nylock 90 screwed onto each of the six studs 74, affixing the entire display panel assembly together.

Figure 5:
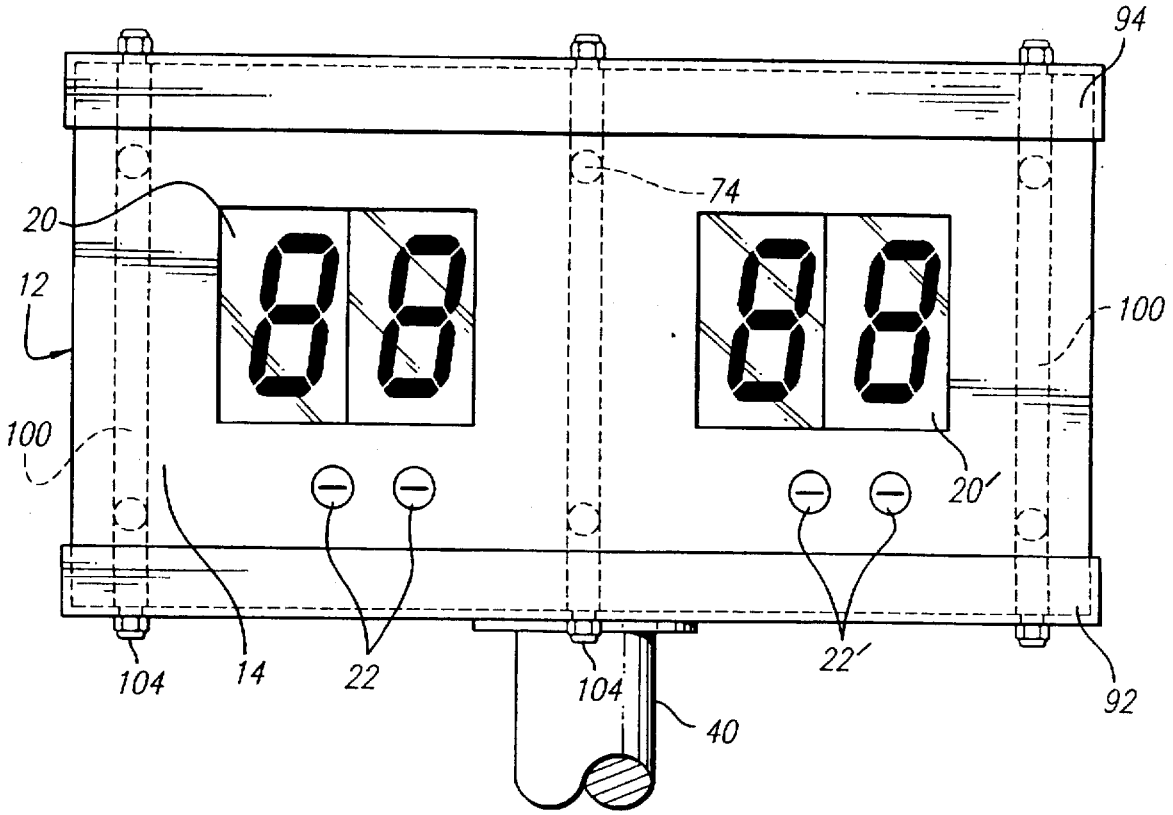
FIG. 5 is a side view of the scoring display housing and the framework thereof.
Figure 6:
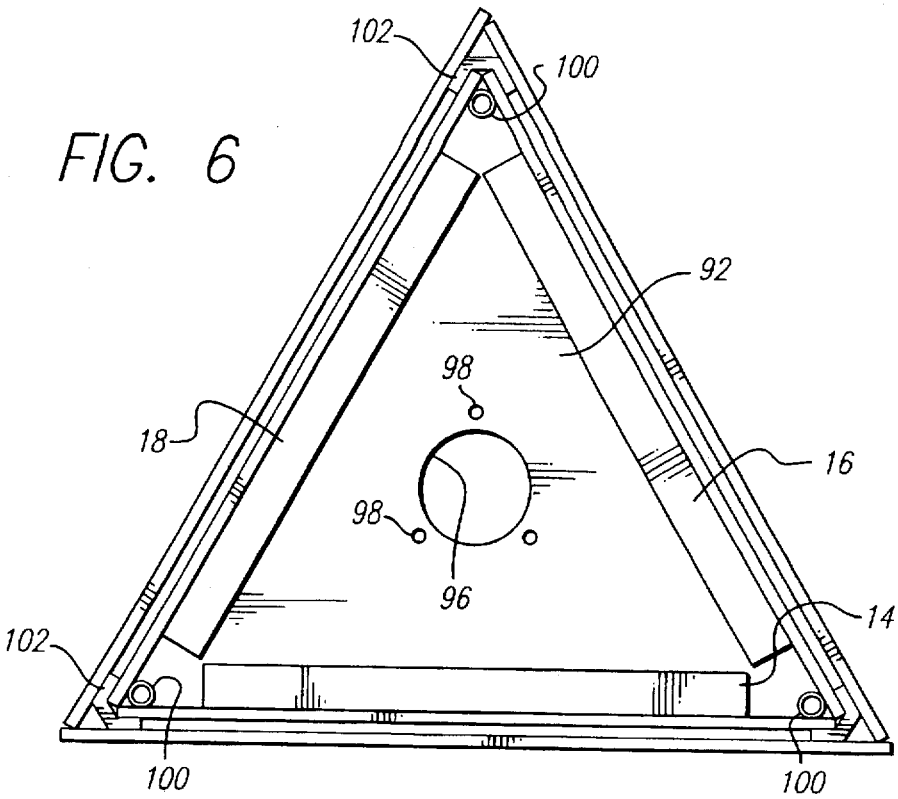
FIG. 6 is a top vies of the scoring display housing with the top cover removed.
Figure 7:
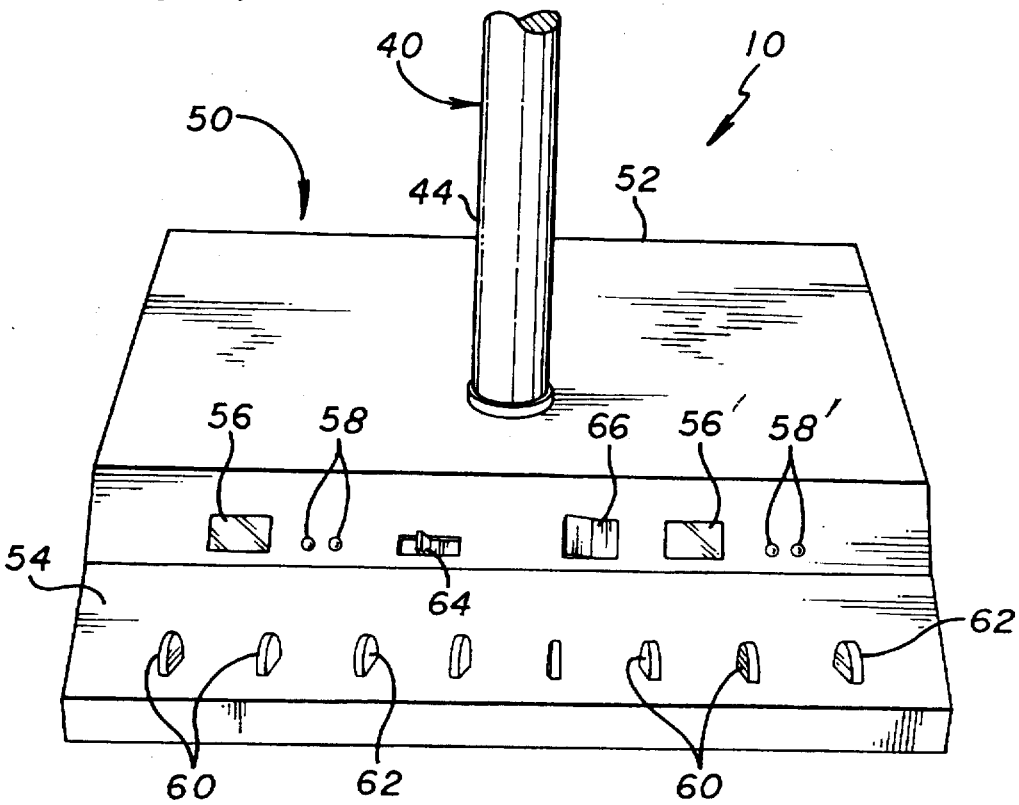
FIG. 7 is a front perspective of the control and display panel of the base control unit of the apparatus.

Referring to FIGS. 5 and 6, the display panel assemblies (14, 16 and 18) are mounted between two panels 92 and 94 to form the scoring display housing 12. Each top/bottom panel 92, 94 is triangular in shape and has a large through hole 96 in the center. A medium-sized screw hole is provided near each of the three corners of the panels. Furthermore, three small screw hoses 98 spaced evenly around the center hole 96 are optional. Each display panel assembly (14, 16 and 18 ) is fitted along one side of the bottom panel 92 and top panel 94. Rubber grommets 102 are installed in each corner of both panels 92, 94. The grommets 102 fit between the ends of the panel assemblies and the sides of the top and bottom panels to help secure the panel assemblies in place. Three spacer bars 100 are installed between the bottom panel 92 and the top panel 94 using screws 104 at the three corner screw hole locations for each top/bottom panel, forming a triangular shaped scoring display housing 12.

The scoring display housing 12 is supported on the upper end 42 of a vertical post 40 which is aligned with hole 96 in the bottom panel 92. In a preferred embodiment, the post 40 is between 4 to 6 feet in length. The opposite lower end 44 of the post as anchored to a base control unit 50.

The base control unit 50 includes a housing 52 structured to contain various electronic components including a battery, battery charger, and a control circuit board. A front face 54 of the control housing 52 is provided with mini displays 56, 56' comprised of ½", seven-segment LED character displays. The mini displays replicate the two character displays on each side of the scoring display housing. The front face 54 of the control housing is further provided with two sets of LED indicators 589 58' which correspond with the two sets of indicators 22, 22' on each side of the scoring display housing 12, for indicating total games won by each team. Additionally, the base control unit 50 includes switches 60 to increase and decrease the current game Scores displayed, as well as switches 62 to increase the total games won by each team. Furthermore, the control unit includes switches 64 to automatically swap game scores when teams change sides of the net during the rubber game of a match. This allows the teams' scores to be instantly swapped to correspond with the side of the net that each team moves to. A power switch 66 enables the unit to be turned on and off, wherein power from either an internal battery or external power source energizes the electronic components of the apparatus 10.

Figure 8:
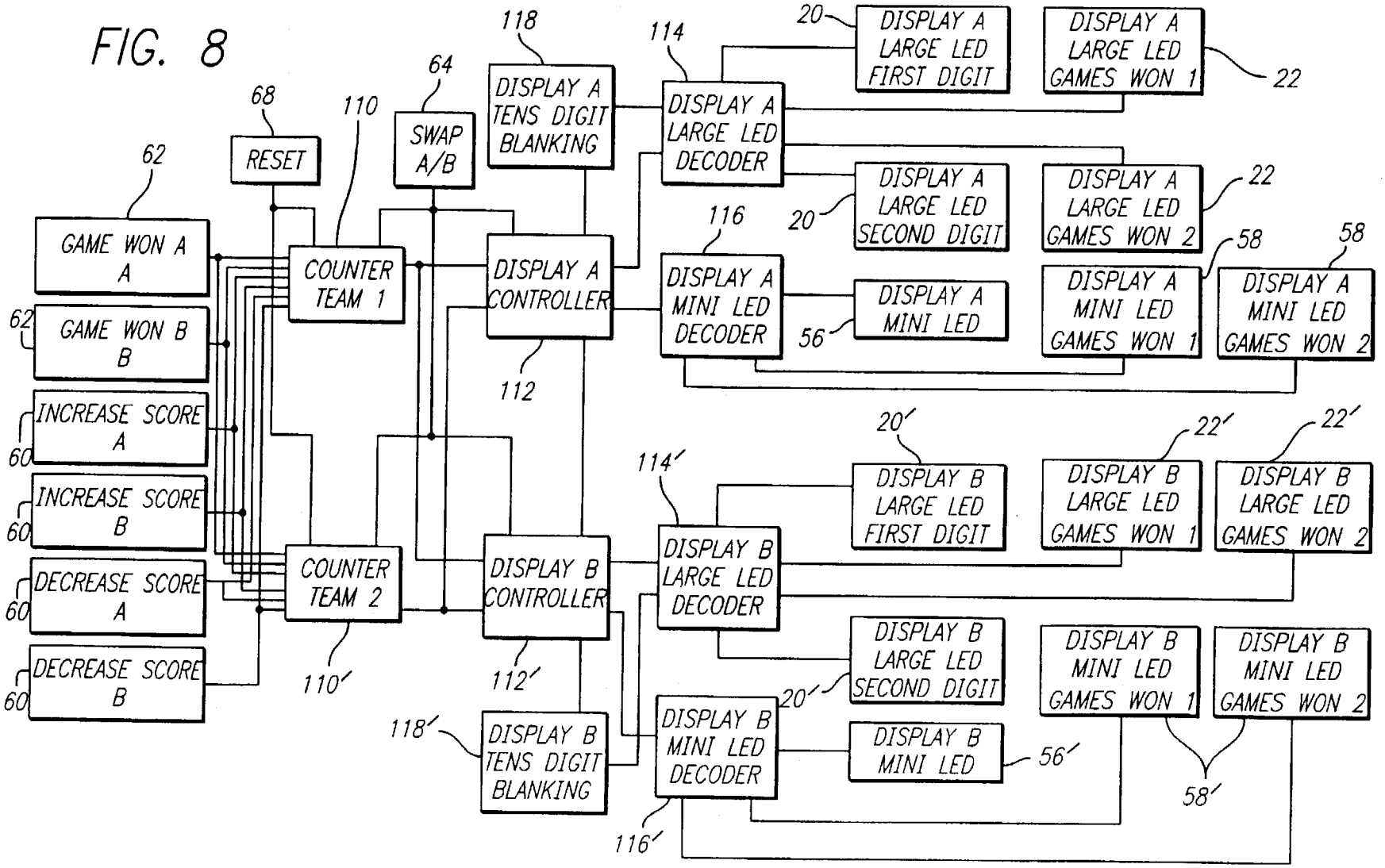
FIG. 8 is a block drawing of the logic circuitry embodied in the system.

Referring to the block diagram of the electronic circuitry in FIG. 8, the increase and decrease score switches 60 and the game won switches 62 each input one pulse into both the counter or Team 1 110 and the counter for Team 2 110' with each depression. The position of the Swap A/B switch 64 determines which signals each counter 110, 110' processes. Either the Team 1 counter will process A data and the Team 2 counter will process B data, or vice versa. The counters 110, 110' track the scoring and number of games won sequentially based on the number of inputs processed. Both counters 110, 110' transmit data to the display A controller 112 and the display B controller 112'. The display controllers 112, 112' multiplex the data from the counters to the data format that the LED decoders (114, 114', 116 and 116') use to instruct the LED readouts (20, 20', 22, 22', 56, 56', 58 and 58') The display controllers 112, 112' are instructed on which set of data, A or B, to multiplex based on the input from the swap A/B switch 64 Additionally, ten digit blanking circuitry 118, 118' is implemented between the display controllers 112, 112' and the large LED decoders 114, 114', respectively, to blank out the large LED tens digit when the score is below ten resulting in an easier to read score.

One power ribbon cable and one data ribbon cable extend from the power and logic circuitry PC boards in the base control unit 50 through the vertical post 40, through the bottom panel center hole 96 and connect to the first display panel assembly 14 via 40 pin IDS connectors 82. The power ribbon cable carries both 5 VDC and 12 VDC power to the display housing 12. The data ribbon cable carries the data from the LED decoders 114, 114' to the large LED's (20, 20', 22 and 22') mounted in The first display panel 14. A second pair of data and power cables are connected from the first display panel assembly 14 to the second display assembly 16. Furthermore, one additional pair of cables are connected from the second display panel 16 to the third display assembly 18, forming a daisy chain.

The apparatus 10 may further be provided with a time clock on the three sides of the scoring display housing 12. In a preferred embodiment, the time clock would be added by providing an additional tier above the character displays on each side of the scoring display housing 12.

Additionally, means can be provided on the scoring display housing 12 for removably attaching a three-sided advertisement display above the character display to the top panel 94 located above the character display panels 14, 16, 18 of the three-sided scoring display housing.

While the instant invention has been shown and described in what is considered to be a preferred and practical embodiment thereof, it is recognized that departures may be made within the spirit and scope of the present invention.

What is claimed is:

1. A scoring apparatus comprising:

means for displaying a score of an event and including a plurality of score display sets, each set including a pair of dual character displays;

a score display housing having a plurality of side faces disposed in angled relation to one another about said housing, each of said side faces having one of said score display sets visibly disposed so that when said housing is supported in an operative viewing position, said score displaying means is visible from 360° about said housing;

a base control unit including base display means corresponding with said score displaying means for simultaneously displaying the score which is displayed on each of said score display sets and control means for controlling said score displaying means and said base display means; and housing support means for supporting said housing in said operative viewing position in spaced relation above said base control unit including a post extending vertically between said base control unit and said score display housing, said post including a lower end zone anchored to said base control unit and an upper end zone attachable to said score display housing.

2. A scoring apparatus as recited in claim 1 wherein said score display housing includes a top panel, a bottom panel and three of said side faces between said top and bottom panels, said side faces being positioned and disposed in a triangular configuration at 60° angles relative to one another.

3. A scoring apparatus as recited in claim 1 wherein said housing support means is structured and disposed to support said housing in said operative viewing position at a distance of at least 3 feet above said base control unit.

4. A scoring apparatus as recited in claim 1 wherein said dual character display is an LED display.

5. A scoring apparatus as recited in claim 1 wherein said dual character display is an electro-mechanical vane display.

6. A scoring apparatus as recited in claim 1 wherein each of said score display sets include means for indicating information relevant to the event other than the score.

7. A scoring apparatus as recited in claim 1 wherein said control means includes switch means externally accessible on said base control unit for operating said control means in order to control said score displaying means and said base display means.

8. A scoring apparatus as recited in claim 7 wherein said control means, said score displaying means and said base display means are structured and disposed for controlling and displaying scores and other relevant information for a plurality of participants of the event.

9. A scoring apparatus comprising:

means for displaying information relevant to an event and including a plurality of display sets, each of said display sets including means for displaying a first participant's indicia and a second participant's indicia;

a display housing having a plurality of side faces disposed in angled relation to one another about said display housing, each of said side faces having one of said display sets visibly disposed so that when said display housing is supported in an operative viewing position, said information displaying means is visible from 360° about said display housing;

a base control unit including base display means corresponding with said information displaying means for simultaneously displaying the information which is displayed on each of said display sets and control means for controlling said information displaying means and said base display means;

housing support means for supporting said display housing in said operative viewing position in spaced relation above said base control unit and including a post extending vertically between said base control unit and said display housing, said post including a lower end zone anchored to said base control unit and an upper end zone removably attachable to said display housing and supporting said display housing in operative viewing position at a distance of at least three feet above said base control unit; and means for swapping said first participant's indicia and said second participant's indicia on each of said display sets.

10. A scoring apparatus as recited in claim 9 wherein said display sets include an LED display.

11. A scoring apparatus as recited in claim 9 wherein said display sets include an electro-mechanical vane display.

12. A scoring apparatus as recited in claim 9 wherein said control means includes switch means externally accessible on said base control unit for operating said control means in order to control said information displaying means and said base display means.

13. A scoring apparatus comprising:

means for displaying a score and other information relevant to an event and including a plurality of score display sets;

a score display housing having a plurality of side faces disposed in angled relation to one another about said display housing, each of said side faces having one of said score display sets visibly disposed so that when said display housing is supported in an operative viewing position, said score displaying means is visible from 360° about said display housing;

a base control unit including base display means corresponding with said score displaying means for simultaneously displaying the score and other information which is displayed on each of said score display sets and control means for controlling said score display means and said base display means; and housing support means interconnected between said housing and said base control unit for supporting said housing in said operative viewing position at a distance of at least 3 feet above said base control unit and including a post extending vertically between said base control unit and said display housing, said post including a lower end zone anchored to said base control unit and an upper end zone attachable to said display housing.

14. A scoring apparatus as recited in claim 13 wherein said score display housing includes a top panel, a bottom panel and three of said side faces between said top and bottom panels, said side faces being positioned and disposed in a triangular configuration at 60° angles relative to one another.

15. A scoring apparatus as recited in claim 13 wherein said control means includes switch means externally accessible on said base control unit for operating said control means in order to control said score displaying means and said base display means.

* * * * *